US010729289B2

(12) United States Patent
Formon et al.

(10) Patent No.: US 10,729,289 B2
(45) Date of Patent: Aug. 4, 2020

(54) SHEET PRODUCT DISPENSER

(71) Applicant: SCA Hygiene Products AB, Göteborg (SE)

(72) Inventors: John S. Formon, Oxford, PA (US); Joseph Wieser, Hartford, CT (US); Matthew T. Woerpel, Lodi, WI (US); Edward A. Raleigh, Lodi, WI (US); Jeffrey J. Brickl, Lodi, WI (US)

(73) Assignee: ESSITY HYGIENE AND HEALTH AKTIEBOLAG, Gothenburg (SE)

( * ) Notice: Subject to any disclaimer, the term of this patent is extended or adjusted under 35 U.S.C. 154(b) by 0 days.

(21) Appl. No.: 14/780,051

(22) PCT Filed: Mar. 28, 2013

(86) PCT No.: PCT/EP2013/056726

§ 371 (c)(1),
(2) Date: Sep. 25, 2015

(87) PCT Pub. No.: WO2014/154285

PCT Pub. Date: Oct. 2, 2014

(65) Prior Publication Data

US 2016/0051100 A1 Feb. 25, 2016

(51) Int. Cl.

| | |
|---|---|
| ***A47K 10/44*** | (2006.01) |
| ***A47K 10/42*** | (2006.01) |
| ***B65B 25/14*** | (2006.01) |

(52) U.S. Cl.

CPC ..... *A47K 10/44* (2013.01); *A47K 10/425* (2013.01); *B65B 25/14* (2013.01)

(58) Field of Classification Search

CPC ..... A47K 10/427

See application file for complete search history.

(56) References Cited

U.S. PATENT DOCUMENTS

| | | | |
|---|---|---|---|
| 1,703,594 | A | 2/1929 | Pratt |
| 2,092,166 | A | 9/1937 | Kettles |

(Continued)

FOREIGN PATENT DOCUMENTS

| | | | |
|---|---|---|---|
| CN | 101014272 | A | 8/2007 |
| CN | 101331063 | A | 12/2008 |

(Continued)

OTHER PUBLICATIONS

Canadian Office Action dated Jun. 23, 2016 in corresponding Canadian patent application No. 2,900,588 (4 pages).

(Continued)

*Primary Examiner* — Gene O Crawford
*Assistant Examiner* — Ayodeji T Ojofeitimi
(74) *Attorney, Agent, or Firm* — Faegre Drinker Biddle & Reath LLP

(57) ABSTRACT

A dispenser is disclosed that includes a housing defining an interior volume for receiving a stack of sheet products, an actuator, a dispensing member, a roller, and a support structure for engaging a front face of the stack including opposed shelves for supporting opposed sides of the front face. The actuator is operable by a user to activate a dispensing member to dispense a desired number of sheet products. The actuator includes two or more user interfaces that a user can actuate to transmit to the dispensing member an amount of movement corresponding to different numbers of sheet products being dispensed depending upon which of the user interfaces is actuated. The roller is located between the opposed shelves and engages and grips on the front face of the stack. The actuator imparts a predetermined amount of rotation to the roller depending upon which of the user interface ledges is actuated, which causes the roller to separate one or more sheet products at the front face of the stack in a one-at-a-time fashion.

15 Claims, 13 Drawing Sheets

(56) References Cited

U.S. PATENT DOCUMENTS

| | | | | |
|---|---|---|---|---|
| 2,772,021 | A | 11/1956 | Kettles | |
| 2,932,426 | A | 4/1960 | Hope et al. | |
| 3,117,694 | A * | 1/1964 | Gothreau | B43M 13/00 221/23 |
| 3,208,634 | A | 9/1965 | Saxe | |
| 3,606,125 | A | 9/1971 | Tucker et al. | |
| 4,372,549 | A * | 2/1983 | Stiernspetz | B65H 3/063 271/119 |
| 5,630,581 | A * | 5/1997 | Rodesch | B65H 3/0623 221/39 |
| 7,219,852 | B2 | 5/2007 | Tramontina et al. | |
| 7,234,610 | B2 | 6/2007 | Skarda et al. | |
| 7,543,423 | B2 | 6/2009 | Long et al. | |
| 9,345,368 | B2 | 5/2016 | Formon et al. | |
| 2002/0139813 | A1 | 10/2002 | Boone et al. | |
| 2004/0007586 | A1 | 1/2004 | Boone et al. | |
| 2006/0273101 | A1* | 12/2006 | Lewis | A47K 10/427 221/56 |
| 2007/0215634 | A1* | 9/2007 | Levin | A61M 5/44 221/231 |
| 2008/0135570 | A1 | 6/2008 | Lee | |
| 2009/0212150 | A1 | 8/2009 | Wruck, Jr. et al. | |
| 2010/0114366 | A1 | 5/2010 | Case et al. | |
| 2010/0224647 | A1 | 9/2010 | Formon et al. | |
| 2011/0132920 | A1* | 6/2011 | Petocchi | A47K 10/424 221/45 |
| 2013/0161346 | A1 | 6/2013 | Wolme et al. | |
| 2014/0014675 | A1* | 1/2014 | Ingvarsson | A47K 5/06 221/155 |
| 2016/0029857 | A1 | 2/2016 | Woerpel et al. | |
| 2016/0045083 | A1 | 2/2016 | Formon et al. | |

FOREIGN PATENT DOCUMENTS

| | | | |
|---|---|---|---|
| CN | 102368941 | A | 3/2012 |
| CN | 202376008 | U | 8/2012 |
| EP | 1238619 | B1 | 10/2007 |
| EP | 2335541 | A2 | 6/2011 |
| FR | 1285715 | A | 2/1962 |
| WO | WO 2006/132696 | A1 | 12/2006 |

OTHER PUBLICATIONS

Canadian Office Action dated Jun. 28, 2016 in related Canadian patent application No. 2,901,336 (4 pages).

First Chinese Office Action dated Feb. 24, 2017 issued in related Chinese patent application No. 201380075004.X (8 pages) and its English-language translation thereof (11 pages).

Colombian Office Action No. 1548 issued in related Colombian patent application No. 15249984 (13 pages) and partial English-language translation of relevant parts thereof (7 pages).

Third Chinese Office Action dated Mar. 20, 2018 issued in corresponding Chinese patent application No. 201380075004.X (8 pages) and its English-language translation thereof (10 pages).

First Chinese Office Action dated May 15, 2017 issued in related Chinese patent application No. 201380074759.8 ( 6 pages) and its English-language translation thereof (5 pages).

Colombian Office Action No. 32248 dated Jun. 5, 2017 issued in related Colombian patent application No. 15249984 (15 pages) and its partial English-language translation therof (7 pages).

Fourth Chinese Office Action dated Sep. 30, 2018 issued in Chinese patent application No. 201380075004.X (5 pages) and its English-language translation thereof (8 pages).

Office Action dated Dec. 21, 2018 issued in U.S. Appl. No. 14/780,039 with double-patenting rejections on pp. 2 and 3.

Second Chinese Office Action dated Sep. 13, 2017 issued in related Chinese patent application No. 201380075004.X (7 pages) and its English-language translation thereof (10 pages).

Colombian Office Action No. 82585 dated Nov. 7, 2018 issued in Colombian patent application No. 15249984 (5 pages) and partial English-language translation of relevant parts thereof (3 pages).

* cited by examiner

SHEET PRODUCT DISPENSER

CROSS-REFERENCE TO PRIOR APPLICATION

This application is a § 371 National Stage Application of PCT International Application No. PCT/EP2013/056726 filed Mar. 28, 2013, which is incorporated herein in its entirety.

TECHNICAL FIELD

The present disclosure relates to a dispenser configured to contain and dispense a stack of sheet products.

BACKGROUND

There are sheet product dispensers in which sheet products are dispensed from a product housing through a dispensing opening. Examples of types of sheet products that are known are hand towels, toilet tissue, napkins, serviettes, and other wiping products in sheet form. A persistent problem with such dispensers is that users may take more than is required, causing waste.

To that end, dispensers are known that dispense a predetermined number of sheet products. Dispensers of this type, however, rely on precise settings, depending on the thickness of the sheet products and/or the level of compression of the stack. Further, dispensers of this type require difficult adjustments to be made in order to vary the predetermined number of sheet products to be dispensed, and are therefore often used so as to always dispense the same number of sheet products.

It would be desirable to provide a sheet product dispenser that is able to tolerate sheet products with different numbers of folds and to also tolerate stacks with differing stack compression levels, without necessarily requiring adjustment to the components of the dispenser.

It would also be desirable to provide a dispenser in which the number of sheet products dispensed by the dispenser can be easily selected.

Lastly, it would be desirable to provide a dispenser that yields a more controlled and tidy sheet product presentation than available with conventional dispensers.

The present disclosure addresses the above and other shortcomings of sheet product dispensers, and provides advantages and improvements that will become clear from the following general and specific description of embodiments of the invention.

SUMMARY

In a first aspect, a dispenser is provided including a housing for a stack of sheet products and a dispensing opening, the dispenser including a dispensing member for engaging a face of a sheet adjacent the dispensing opening, the dispensing member being moveable and adapted for gripping the sheet, whereby movement of the dispensing member causes the gripped sheet to slide relative to an underlying sheet face in the stack to separate a sheet product adjacent the dispensing opening from the stack.

According to the first aspect, the dispensing member grips a sheet product adjacent the dispensing opening and causes it to slide relative to an underlying sheet product to allow the gripped sheet product to be moved relative to, and separated from, the remaining stack. The stack is engaged at a face of the stack adjacent the dispensing opening and so does not rely on precise picking of a predetermined number of sheets.

A thickness of each sheet product from the edge side changes depending upon compression, and the compression changes depending upon weight or depth of the remaining stack. The number of sheets can be controlled by setting an amount of movement of the dispensing member to dispense one sheet product and repeating this amount of movement for each further sheet product to be dispensed. The amount a sheet is required to slide relative to an underlying sheet does not change depending on the number of sheet products in the remainder of the stack. Thus, the first aspect allows a desired number of sheets to be dispensed in a consistent manner.

In an embodiment, the dispenser housing is configured for holding the stack of sheet products in an interior volume thereof so that the front face of the stack is adjacent the dispensing opening. The dispensing member is positioned to engage the front face of the stack and may protrude into the interior volume. The dispensing member is positioned to press into the front face of the stack, in the stacking direction, so that the front-most sheet product in the stack is gripped and moved while being pressed against underlying sheet products in the stack. This causes the front-most sheet product at the location at which it is gripped to rub against underlying sheets in the stack as it is moved relative to the underlying sheets. The stack may be weighted against or otherwise biased against the dispensing member.

In an embodiment, the dispensing member is configured for moving a fold or edge of a sheet product by gripping and moving a face of the sheet product adjacent the fold or edge.

In an embodiment, the dispensing member is configured for moving a fold or edge of a sheet product adjacent the dispensing opening along a face of an underlying sheet in the stack to separate that sheet product from the stack.

In an embodiment, the dispensing member is configured for moving the sheet product past a barrier so that once the barrier is cleared, the sheet product passes through the dispensing opening. In an embodiment, the dispensing member itself serves as the barrier that has to be cleared for the sheet product to be passed through the dispensing opening.

In an embodiment, the arrangement is such that the sheet product gripped by the dispensing member rubs against an underlying sheet product as it is moved by the dispensing member, but the frictional interaction of one face of the sheet product with the dispensing member is greater than the frictional force between the opposed face of the sheet product and the underlying sheet product in the stack, thereby allowing the gripped sheet product to move relative to a remainder of the stack in a sliding manner.

The dispensing member has a suitably chosen surface that interacts with the surface of a sheet product adjacent the dispensing opening. The surface is selected so as to achieve a relatively high frictional force with the sheet product. For example, and without limitation, the surface of the dispensing member may be made of an elastomeric material, it may be tacky to the touch, it may be textured such as by way of grooves aligned with the direction of movement or cross grooves, hatching, dimples or the like. The skilled person would be able to suitably select the form and material of the dispensing member to ensure sufficiently high grip on the sheet products.

In an embodiment, the dispenser includes a support structure against which the dispensing face of the stack is supported. The support structure may be configured to hold the stack in position against a weight of the stack (e.g., in a gravity feed dispenser) or for holding the stack in position against a biasing member acting on the stack (e.g., in an in-counter, on-counter or tabletop dispenser). The dispensing face of the stack is pressed against the support structure by virtue of the weight of the stack or the urging provided by the biasing member. In an embodiment, the support structure includes at least one wall. In an embodiment, the support structure reveals part of the dispensing face and the dispensing member is positioned to engage the revealed part of the dispensing face of the stack. The dispensing member is configured to move the sheet being gripped off the support structure to separate the sheet product from a remainder of the stack for dispensing from the dispensing opening.

In an embodiment, the dispenser includes a housing defining an interior volume in which the stack is disposed. The stack includes a front face and a back face and four sidewalls extending there between. The four sidewalls are made up of folds or edges of the sheet products in the stack, whereas the front face is made up of a major surface of the front-most sheet product or products and the back face is made up of a major surface of the back-most sheet product or products. The dispensing member is positioned to operate on the front face of the stack. It is the front-most sheet product or products that are gripped by the dispensing member and moved relative to underlying sheets in the stack to dispense the sheet product.

In an embodiment, the dispenser includes a support structure for engaging and supporting a front face of the stack adjacent, in a stacking direction, the dispensing opening. The dispensing member is positioned so as to engage the front face of the stack at or above the level of the support structure in the stacking direction. In this way, both the support structure and the dispensing member have the front face of the stack pressed thereon by virtue of the weight of the stack (i.e., by virtue of gravity) or by a biasing member. The support structure in that embodiment is configured for engaging opposed margin areas of the front face of the stack. The dispensing member is positioned in the space between the opposed margin areas to also engage the front face of the stack. The dispensing opening is located between the part of the support structure engaging one of the margin areas and the dispensing member. The dispensing member is operable to move a sheet product that it grips and engages into the dispensing opening.

In an embodiment, the support structure and the dispensing member are arranged so that one side of the sheet product is moved clear of the support structure into the dispensing opening, while another side of the sheet product remains supported by the support structure. This is particularly useful in a gravity feed dispenser embodiment so that one side of the sheet product hangs through the dispensing opening for grasping by a user, while the other side remains pinched between the support structure and the remainder of the stack to keep the dispensing tidy. An embodiment in which part of the sheet product is held by the support structure and another part is moved clear of the support structure by the dispensing member is discussed further below with respect to the third aspect. These features may be combined with the first aspect.

In an embodiment, one or more shelves are included to support the dispensing face of the stack adjacent the dispensing opening. The dispensing member is positioned adjacent the shelf and is configured for moving the sheet off the shelf to separate a sheet product from the remainder of the stack for dispensing through the dispensing opening.

In an embodiment, the dispensing member turns to provide the movement required to slide the sheet to separate the sheet product from the remainder of the stack. An axis about which the dispensing member turns is disposed parallel to faces of the sheet products in the stack. The axis may also be aligned with a margin portion of the front face of the stack that the shelf or support structure engages.

In an embodiment, the dispensing member is provided as a roller engaging the face of a sheet product adjacent the dispensing opening. In that embodiment, a peripheral surface of the roller grips the face of the adjacent sheet product.

The roller may define a cylindrical outer profile for engaging the sheet product or it may have a lobed outer profile. The lobed outer profile may be useful for moving the gripped sheet product by a set amount as defined by the protruding portion of a lobe of the outer profile, while allowing relative rotation between the roller and the relatively recessed part of the lobed profile. The lobed outer profile may have one, two, three, four or more lobes. The roller may be configured for dispensing one sheet product per lobe. The cylindrical outer profile allows greater tolerance in dispensing a predetermined number of sheet products because it does not require lobe registration.

In an embodiment, the dispensing member is positioned closer to one edge of the front face of the stack than to an opposed edge. The dispensing member is configured for moving the closer edge of a sheet product adjacent the dispensing opening into the dispensing opening for grasping by a user. This asymmetrical positioning of the dispensing member reduces the likelihood of slippage since there is a reduced distance to travel to dispense the sheet product.

In an embodiment, the dispenser includes an actuator that is user-operable to cause the dispensing member to move relative to the sheet products in the stack to dispense one or more sheet products. The actuator may be as described below with respect to the second aspect. In an embodiment, the actuator may include a rotatable knob or it may include a button. In an embodiment, the rotatable knob can be rotated a different amount (e.g., a different number of turns or half-turns) to move the dispensing member by a different amount to dispense a different number of sheet products. In another embodiment, the actuator includes a plurality of buttons that may be selectively actuated to cause the dispensing member to move respective different amounts to thereby dispense different respective numbers of sheet products.

In an embodiment, the dispensing member is moveable to move a sheet product adjacent the dispensing opening into or through the dispensing opening. As the preceding sheet is cleared by moving it into the dispensing opening, the dispensing member engages and grips a succeeding sheet for moving the succeeding sheet into or through the dispensing opening for grasping by a user. Specifically, the dispensing member is arranged to operate on the front face of a sheet product adjacent the dispensing opening so that when that sheet product moves into the dispensing opening and is clear of the dispensing member, the succeeding sheet product in the stack is engaged by the dispensing member.

According to a second aspect, a dispenser is provided that includes a housing for a stack of sheet products, a dispensing opening, a dispensing member for dispensing a selected number of sheet products through the dispensing opening. The dispenser also includes an actuator operatively coupled to the dispensing member that is user-operable to selectively cause the dispensing member to dispense a first predetermined number of sheet products and that is also user-operable to selectively cause the dispensing member to dispense a second, different (e.g., greater) number of sheet products.

The second aspect allows a user to operate an actuator to selectively cause one of at least two different numbers of sheet products to be dispensed. In this way, different dispensing requirements can be met in an easy to operate way.

In an embodiment, the actuator is user-operable to selectively cause the dispensing member to dispense a third number, different from (e.g., greater than) the second number, of sheet products. In this way, small, medium and large sheet product requirements can be met.

In an embodiment, the dispensing member moves to segregate a different number of sheet products from the remainder of the stack depending upon operation of the actuator to dispense the different number of sheet products.

In an embodiment, the dispensing member is configured to turn relative to the stack, with the amount of turning differing depending upon operation of the actuator to dispense the different number of sheet products. In an embodiment, the dispensing member is a roller and the amount of rotation or number of revolutions of the roller differing depending upon operation of the actuator to dispense the different number of sheet products.

In an embodiment, the dispensing member causes sliding movement of a sheet product adjacent the dispensing opening against an underlying sheet product in the stack. This, in turn, moves the sheet product relative to the remainder of the stack and into or through the dispensing opening. In an embodiment, the dispensing member engages a succeeding sheet product after dispensing the preceding sheet product so as to be able to move the succeeding sheet product into or through the dispensing opening by sliding against an underlying sheet in the stack.

In an embodiment, the dispensing member is able to engage a succeeding sheet product in the stack once a sheet product adjacent the dispensing opening has been moved clear of the dispensing member so that both, the adjacent sheet product and the succeeding sheet product, may be dispensed.

In an embodiment, the dispensing member moves by a first amount to thereby dispense the first number of sheet products and moves by a second, greater, amount to dispense the second number of sheet products. The movement may be rotation. In an embodiment, a particular amount of movement, e.g., rotation, dispenses one sheet product and an integer multiple of the particular amount of movement dispenses a corresponding integer multiple number of sheet products.

In an embodiment, the actuator includes different user interfaces for actuating the different numbers of sheet products for dispensing. The user interfaces may be, for example, buttons, levers, indexes, or electronic buttons. The actuator and the dispensing member cooperate to dispense the number of sheet products depending upon the user interface operated. The different user interfaces may be independently operable by a user to cause the different number of sheet products to be dispensed. In an embodiment, the different user interfaces are push buttons. In an embodiment, the different user interfaces are pressed by a user through an actuation stroke.

In an embodiment, the actuator includes a converter for converting between types of motion so that the motion of a user interface part of the actuator in one direction is changed to motion in another direction or in another sense (i.e., linear to rotation or vice versa) of the dispensing member. The converter may additionally or alternatively include mechanical advantage transmission. In an embodiment, the converter converts linear motion of a moveable part of the actuator to rotating motion of the dispensing member that is configured for engaging and moving one or more sheet products into or through the dispensing opening.

In an embodiment, the actuator includes a gear assembly providing transmission between a user interface part or parts of the actuator and a dispensing member. In an embodiment, the gear assembly is configured so that an actuation stroke of different user interface parts causes the dispensing member to respectively dispense the different number of sheet products. That is, the gear assembly is configured to transmit different amounts of movement to the dispensing member despite the same length actuation stroke being applied to different user interface parts of the actuator.

In an embodiment of the actuator described above with respect to the first and second aspects, an adjuster may be provided to allow adjustment in the amount of resulting movement of the dispensing member in a stroke of the actuator. This facilitates compensation for different degrees of slippage encountered between the dispensing member and sheet products having different slip properties.

In an embodiment, the actuator has a defined stroke length defined between a moveable part of the actuator and a finger stop of a stationary part of the actuator. In an embodiment, the stroke length differs depending upon which user actuation interface is pressed. More specifically, in that embodiment, different stroke lengths correspond to different lengths of the path travelled by the moveable part to the finger stop. In an embodiment, an adjuster is provided to allow the user to change the stroke length.

According to a third aspect, a dispenser is provided that includes a housing defining an interior volume for supporting a stack of sheet products, with the interior having a maximum depth in the stacking direction of the stack, and a maximum area perpendicular to the stacking direction. The dispenser has a dispensing opening and stack support structure around the dispensing opening for engaging a front face of the stack having the maximum area on one side of the front face and on another side of the front face, and a dispensing member for releasing a sheet product at the one side of the front face of the stack to extend through the dispensing opening while the sheet product remains supported by the support structure at the other side of the front face of the stack.

The third aspect provides a dispenser in which sheet products such as napkins are present in a tidy and ready-to-grasp manner to the user. The dispensing member releases at least one sheet product from one side, but does not release the other side, so that the sheet product is able to extend through or hang through the dispensing opening held or suspended from the other side. The user can then reach into a grasping area of the dispenser adjacent the dispensing opening to take the at least one sheet product. This two step, tidy dispensing process provides certainty as to the number of napkins dispensed, and prevents users from simply reaching in and grabbing an undetermined (typically large) number of napkins. Further, this aspect also provides a support structure around the dispensing opening that can be made small in size to minimize the risk of tearing.

The housing, the support structure and the dispensing opening of the third aspect are applicable to any of the preceding aspects and embodiments. In particular, the dispensing member may be a dispensing member according to the first aspect, with the dispensing member having the above releasing functionality while the support structure holds a side of the sheet product. Further, the dispensing member of the third aspect and its functionality with the support structure and dispensing opening may be combined with the second aspect so that the actuator is operable by a user to actuate the dispensing member.

In an embodiment, the one side and the other side are opposed sides of the stack. In an embodiment, the maximum area is defined by a maximum x and a maximum y dimension (perpendicular x and y, as is conventional), wherein the one side and the other side are opposed in the y direction and the dispensing opening takes on the x dimension for at least part, optionally most, and optionally all, of the way between the one side and the other side. This allows the sheet product to extend through the dispensing opening substantially uncompressed on either x side and also allows the sheet product to extend through the dispensing opening in a free, easy-to-grasp and visually pleasing style.

In an embodiment, the dispensing member is configured to engage and operate on the front face of the stack to move the one side of the sheet product off the support structure. In an embodiment, the dispensing member separates the engaged sheet product from the support structure at the one side and into the dispensing opening to clear the sheet product from the dispensing member so that the dispensing member engages an underlying sheet product. The dispensing member is operable to subsequently release the underlying sheet product for extension through the dispensing opening. In an embodiment, the dispensing member includes a roller that is arranged to engage the front face of the stack and rotate to move the sheet product relative to the support structure on the one side to release the one side of the adjacent sheet product and to position that sheet product in/through the dispensing opening.

In an embodiment, the dispensing member is configured to release a plurality of sheet products at the one side while the plurality of sheet products remains secured at the other side so that a plurality of sheet products extends through the dispensing opening. The dispensing member may be configured to release the sheet products in a one-at-a-time fashion.

In an embodiment, the dispensing member is configured to grip the sheet product and the dispensing member is operable to release the sheet product from the dispensing member to allow the sheet product to extend through the dispensing opening while being secured at the other side.

In an embodiment, the dispenser is configured so that the stack is pressed against the support structure. This could be by way of gravitational force (gravity feed dispenser) or by way of spring force (table top, countertop or in-counter dispenser) or the urging force of some other biasing member. The support structure and the interior volume is such that the other side of the sheet product is pinched between the support structure and the remainder of the stack.

In an embodiment, the dispenser is a gravity feed dispenser in which the interior volume is adapted to be positioned above the dispensing opening. In such an embodiment, the released sheet product hangs with the other side suspended by the support structure. The dispenser may include a sheet product support for supporting a hanging part of the sheet product beneath the dispensing opening. The sheet product support may include a peripheral cut-out to allow a user to grasp the hanging sheet product from opposing faces thereof.

In an embodiment, the support structure at the one side and/or at the other side is able to be adjusted and/or the dispensing member is able to be adjusted to move the front face of the sheet products into stronger or weaker engagement with the dispensing member. This adjustment allows the dispensing member to be operable on different types of sheet products such as sheet products being more or less slippery.

According to a fourth aspect, a method is provided for supplying a stack of sheet products for loading in the housing of the dispenser of any of the embodiments and aspects described herein.

The fourth aspect is applicable to all of the aspects and embodiments disclosed herein. In an embodiment, the method includes loading a stack of sheet products in the dispenser. The sheet products supplied are interrelated to the dispensing member described above in that the dispensing member must work with the particular type of sheet product so as to dispense the sheet product or the desired number of sheet products. In particular, sheet products from different suppliers may have different slippage properties relative to the dispensing member, so that the amount of movement (e.g., rotation) of the dispensing member is somewhat dependent on the type of sheet product. In an embodiment, the method includes adjusting the dispensing member or the relationship between the sheet product and the dispensing member depending upon properties of the particular type of sheet product in the dispenser.

BRIEF DESCRIPTION OF THE FIGURES

FIGS. 7A, 7B, 7C, 7D, 7E, 7F, 7G, 7H, and 71 show perspective views of an exemplary construction for the roller and a number of alternative constructions.

DETAILED DESCRIPTION OF PARTICULAR EMBODIMENTS

Figure 1:
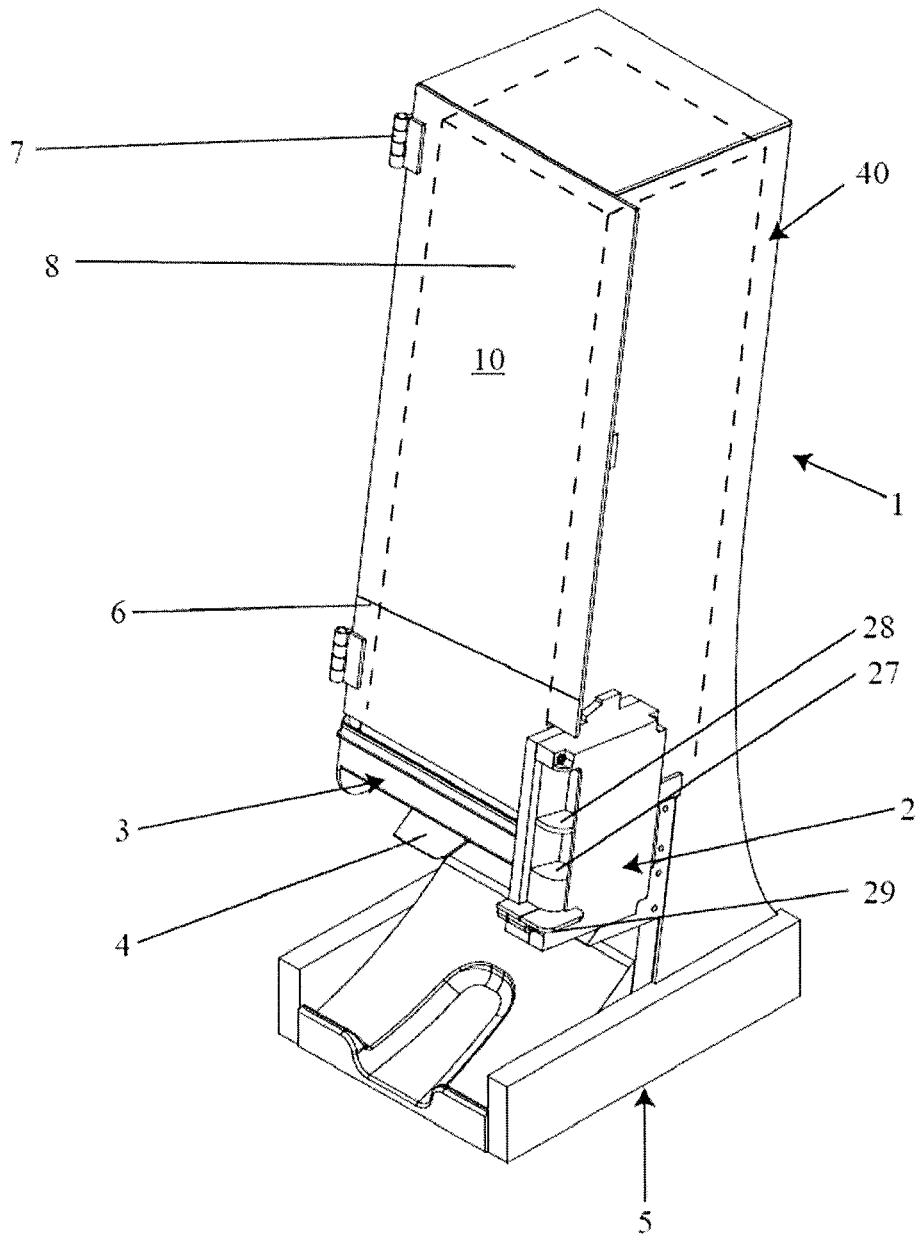
FIG. 1 shows a perspective view of a dispenser according to an embodiment of the present invention.

FIG. 1 shows an embodiment of a dispenser 1. The dispenser includes a housing defining an interior volume for receiving a stack of sheet products. The dispenser includes an actuator and a dispensing member, wherein the actuator is operable by a user to activate a dispensing member to dispense a desired number of sheet products. The actuator includes two or more user interfaces, which are in the form of ledges in the shown embodiment, that a user can selectively press to transmit to the dispensing member an amount of movement corresponding to different number of sheet products being dispensed depending upon which of the user interfaces is pressed. In that particular embodiment, the stroke length of the actuator is different for each of the different user interfaces, in order to transmit different amounts of movement to the dispensing member for dispensing different numbers of sheet products.

The dispenser 1 includes a housing 40 defining an interior volume for containing a stack of sheet products 10. The sheet products may be interfolded and may be napkins. More generally, the sheet products have a wiping function. The housing 40 is provided atop a stand 5 having feet for positioning on a horizontal surface such as a counter top. The housing 40 includes a distal wall defining supporting surface for the stack 10, sidewalls for laterally containing the stack 10, and a proximal wall 8 for preventing the stack 10 from spilling toward a user. The front wall 8 in the illustrated embodiment includes a door that opens about hinges 7 in order to allow the stack 10 to be loaded. In an alternative embodiment, instead of a door, the front wall may alternatively include a passage extending in the stacking direction to allow a user to reach into the interior volume defined by the housing 40. The housing 40 is open at the top (or the rear in the stacking direction) in order to allow the housing 40 to be top-loaded from above. When the feet of the stand 5 are positioned on a horizontal surface, the surface of the distal wall of housing 40 that supports the edges or folds in the stack is, in this exemplary embodiment, inclined backwards relative to vertical.

The housing 40 and the stand 5 in this shown embodiment are structured to define a gravity feed dispenser. The aspects and embodiments described above, and which are explained in further detail below, are broadly applicable to different types of dispensers, such as, and without limitation, tabletop napkin dispensers, folded bath tissue dispensers, hand towel folded or interfolded dispensers, countertop napkin dispensers, or in-counter napkin dispensers. As stated above, the sheet products are generally used for wiping, and may be folded and/or interfolded and may be tissue-based sheet products.

FIG. 1 shows an actuator 2 that is mounted to a side of the housing 40 and which is operatively coupled to a dispensing member 3 in order to cause one or more sheet products to be dispensed. The actuator 2 includes different user interfaces 27, 28 that define different stroke lengths of the actuator 2 to thereby permit the user to select one of different numbers of sheet products available for dispensing by the dispensing member 3.

Figure 2:
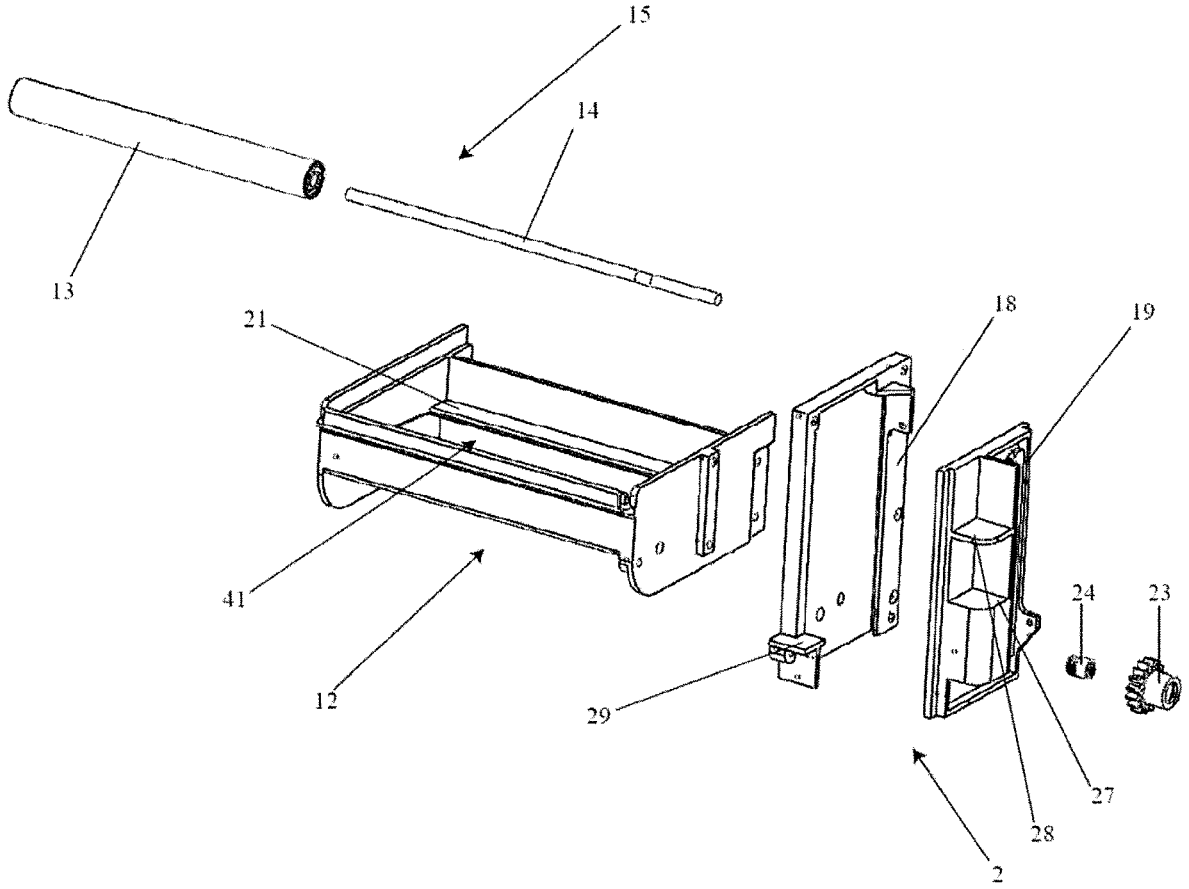
FIG. 2 shows an exploded view showing various parts of the dispensing member and actuator of FIG. 1 in greater detail.

FIG. 2 shows an embodiment of the dispensing member 3 and the actuator 2 with various parts separated, for ease of understanding. FIG. 2 also shows a support structure for a front face of the stack including opposed shelves for supporting opposed sides of the front face of the stack. In between the opposed shelves, a roller of the dispensing member is located, which engages and grips on the front face of the stack. The actuator imparts a predetermined amount of rotation to the roller, which causes the roller to engage and separate one or more sheet products from the front face of the stack in a one-at-a-time fashion. A different amount of rotation is imparted to the roller depending upon which of the user interface ledges is pressed, thereby allowing different numbers of sheet products to be selectively dispensed.

A support structure 12 mounts at a front end or at a bottom end of the housing 40. The support structure 12 defines shelves 21, 22 (see also FIG. 4) that interface with a front face of the stack 10 of sheet products. The front face of the stack of sheet products 10 is defined by a surface of the front-most sheet or sheets in the stack 10.

In the illustrated gravity feed dispenser embodiment, the front face of the stack rests on the shelves 21, 22 and supports a majority of the weight of the stack 10. The rear surface of the housing 40 in this embodiment takes up a relatively minor component of the weight of the stack 10. The shelves 21, 22 contact opposed margins of the front face of the stack of sheet products and define a dispensing opening 41 in the space between the shelves 21, 22. The support structure 12 further includes walls surrounding the shelves 21, 22 for supporting fold or edge faces of a front portion of the stack 10.

A roller 15 of the dispensing member 3 is rotatably mounted to the support structure 12 in a position adjacent a proximal shelf 22 (see FIG. 4), where the proximal shelf 22 is the shelf closest to the user, in use. The roller 15 is made up of a core or central shaft 14 made of a relatively rigid material, and an outer cladding portion 13 that may be injection-molded or extruded and that may have greater gripping characteristics relative to the material of the sheet products, at least on the outer surface of the cladding portion 13, than does the central shaft 14. The central shaft 14 protrudes through at least one side of the support structure 12 for coupling with the actuator 2, in the manner described below. This extension of the central shaft 14 through the support 12 can be seen in FIG. 3.

Figure 3:
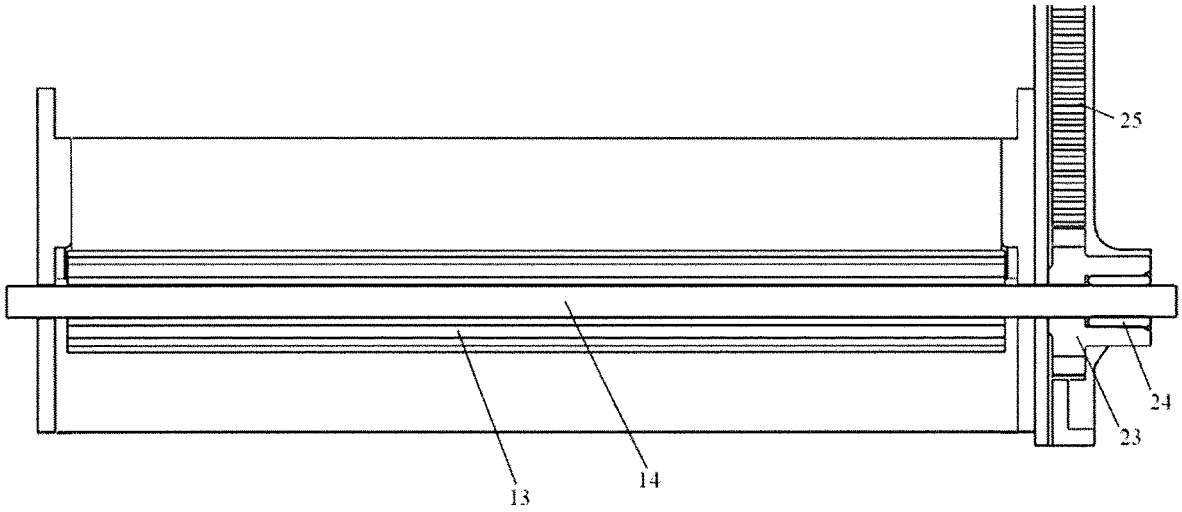
FIG. 3 shows a cross-section of the dispensing member and actuator of FIG. 1 through a central axis of the roller to reveal a rack and pinion device defining the interaction between the actuator and the dispensing member.

FIG. 3 shows a cross-section of the dispensing member and actuator of FIG. 1 through a central axis of the roller to reveal a rack and pinion device defining the interaction between the actuator and the dispensing member. That interaction is such that linear movement of the actuator causes rotational movement of the roller.

The dispensing member 3 further includes a circular gear 23 and a one-way clutch 24 mounted to the central shaft 14 of the roller 15. The circular gear 23 serves as a pinion component that interacts with a rack component 25 of the actuator 2 described in further detail below. The one-way clutch 24 ensures that the roller 15 is only able to be rotated by actuation of the actuator 2 in the dispensing direction, since reverse rotation may be detrimental to the dispensing operation in the illustrated embodiment.

Figure 5:
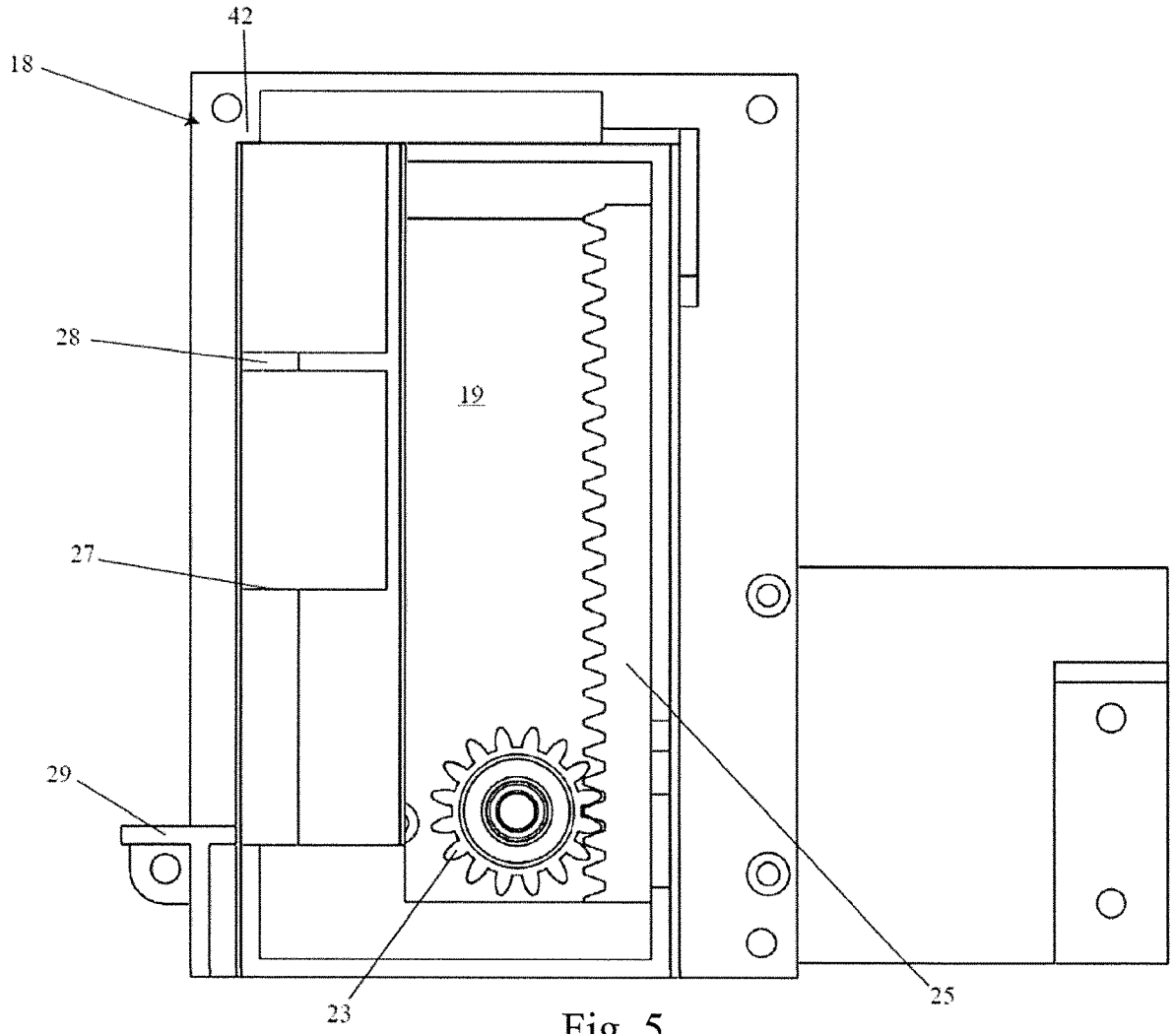
FIG. 5 shows a more detailed view of the rack and pinion device of the dispenser of FIG. 1 for converting linear motion of a moveable actuator part of the actuator to rotational motion of the roller.

The actuator 2 can be further understood with reference to FIGS. 2 and 5. FIG. 5 shows a more detailed view of the rack and pinion device of the dispenser of FIG. 1 for converting linear motion of a moveable actuator part of the actuator to rotational motion of the roller. One end of a stroke of the moveable actuator part is defined by abutment against a portion of a stationary actuator part. The other end of the stroke of the moveable actuator part is defined by a user's fingers extending from one of the user interface ledges of the moveable actuator part and a finger stop on the stationary actuator part against which a user's finger will abut.

The actuator 2 includes a moveable actuator part 19 and a stationary actuator part 18. The stationary actuator part 18 is mounted to a side of the housing 40 and a side of the support structure 21, while the moveable actuator part 19 is mounted to the stationary actuator part 18 for moving linearly, relative thereto. The moveable actuator part 19 includes the rack component 25, in the form of a gear in the illustrated embodiment that meshes with the circular gear 23 of the dispensing member 3 to form a rack and pinion arrangement. This rack and pinion arrangement converts linear movement of the moveable actuator part 19 into rotational movement of the roller 15.

The moveable actuator part 19 includes a plurality of user interface ledges 27, 28 that are proximally positioned on the dispenser 1 and which are sized for contact by the user's forefinger and middle finger. A user is able to push down on the ledges, in order to impart linear movement to the moveable actuator part 19 and thus to impart rotational motion to the roller 15. A stroke length of the moveable actuator part 19 defines the degree to which the roller 15 is moved and consequently the number of sheet products that are dispensed.

The stationary actuator part 18 of the actuator 2 includes a finger stop 29 against which the user's fingers will abut when pushing on one of the user interface ledges 27, 28. In that regard, the finger stop 29 defines a stopping point for the stroke of the moveable actuator part 19. The lower user interface ledge 27 has a shorter distance to move, before aligning with the finger stop 29, than does the upper user interface ledge 28. The two distances thereby respectively define shorter and longer linear movements for the rack component 25, which in turn correspond respectively to smaller and larger amounts of rotation of the roller 15. The user interface ledges 27, 28 respectively define a first number of sheet products for dispensing and a second, larger, number of sheet products for dispensing. For example, the first user interface ledge 27 may correspond to dispensing of one individual sheet product or it may correspond to dispensing of one fold of interfolded sheet products, which would for example thus yield/dispense two individual sheet products. The second user interface ledge 28 may dispense twice this number, so it may dispense two individual sheet products or two folds of interfolded sheet products, specifically four individual sheet products.

The moveable actuator part 19 abuts against an abutment portion 42 that defines a rest position of the moveable actuator part 19 relative to the stationary actuator part 18. Although not shown, the moveable actuator part 19 is biased to return to the starting position defined by the moveable actuator part 19 abutting against the abutment portion 42 of the stationary actuator part 18, such as by way of a spring. The one-way clutch 24 allows rotation of the circular gear 23 to be transferred to the central shaft 14 of roller 15 when the user imparts linear motion to the rack component 25 by moving the moveable actuator part 19. However, when the spring returns the moveable actuator part 19 back to its rest position with the abutment portion 42, the one-way clutch 24 causes the circular gear 23 to disengage so as not to impart further rotational movement to the central shaft 14 or any other portion of roller 15.

Figure 4:
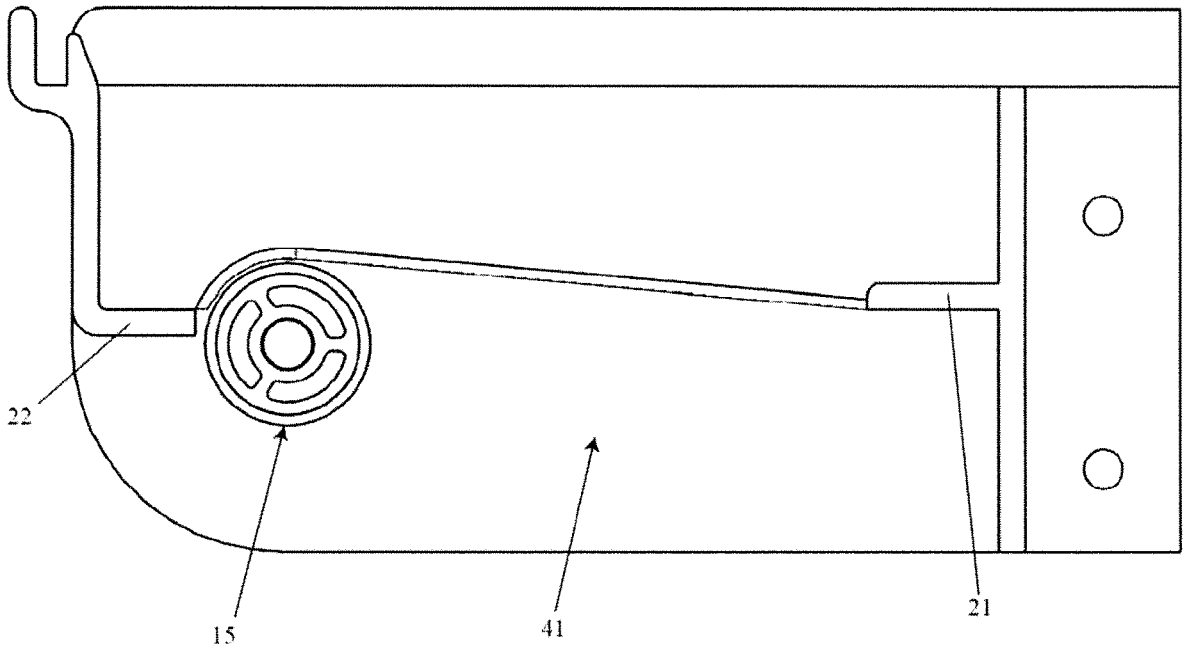
FIG. 4 shows a cross-section of the dispenser of FIG. 1 in which a vertical relationship (the vertical direction being the stacking direction) between the roller and proximal and distal shelves of the support structure (with the proximal shelf being closer to the user).

FIG. 4 shows a cross-section of the dispenser of FIG. 1 in which a vertical relationship (the vertical direction being the stacking direction) between the roller and proximal and distal shelves of the support structure (with the proximal shelf being closer to the user). The proximal shelf is positioned so that the stack has to bend around the dispensing roller, while the distal shelf is positioned more level with the roller.

Referring to FIG. 4, that figure shows the relative positions of the proximal shelf 22, the distal shelf 21 and the roller 15. In particular, that figure shows the shelves 21, 22 and the outer surface of the roller 15 being positioned generally in alignment with respect to the stacking direction, so that the front face of the stack 10 contacts and is supported on the distal support shelf 21, the roller 15 and the proximal support shelf 22. The roller 15 is positioned adjacent the proximal support shelf 22 and a dispensing opening 41 is defined in the gap between the distal support shelf 21 and the roller 15. At least a portion of the outer surface of the roller 15 is positioned above the proximal support shelf 22 to cause the front face of the stack 10 to curve around the roller 15 to some degree, so as to ensure a large contact area and also sufficient pressure between the front-most sheet product and the roller 15, to avoid or at least minimize slippage.

The roller 15 functions to grip a major surface of part of a sheet product at the front of the stack, and to move it off the proximal shelf 22 by sliding same relative to an underlying sheet in the stack. The roller 15 then passes the sheet product into the dispensing opening 41 once the fold or edge of the gripped sheet product is moved beyond the roller 15. Once a particular sheet product has been moved into/through the dispensing opening 41, the succeeding sheet in the stack will rest against the roller 15.

The roller 15 in this embodiment has a circular cross-section. The outer surface of the roller 15 is required to grip the material of the sheet product. Accordingly, the outer surface of the roller 15 may include sandpaper, may be textured, or may include dimples or ribs, or may be made of a material that has a high frictional relationship with the material defining the sheet product, such as an elastomeric material. The outer surface may additionally or alternatively include a grooved or raised pattern such as a hatching pattern to increase grip. In other grip-enhancing alternatives, the outer surface of the roller 15 may be provided by axially or radially extending teeth, with the teeth being angled toward or against the direction of rotation when dispensing a sheet product, or they may have a rectangular or sharp profile.

The roller 15 rotates so that the outer surface thereof moves in the direction away from the proximal shelf 22 and towards the distal shelf 21 at the location of engagement with the front face of the stack 10. This causes the sheet product to move away from the proximal shelf 22 and toward the distal shelf 21. The roller 15 thus does not cause the sheet product to move off the distal shelf 21, so that the proximal part of the sheet product moves into/through the dispensing opening 41, while a distal margin of the sheet product remains supported on the distal shelf 21, pinched between the remainder of the stack and the distal shelf 21. As such, the sheet product gripped by the roller 15 will be released into/through the dispensing opening 41 to hang suspended from a distal margin at the distal shelf 21.

Referring to FIG. 4, the support structure 12 may include proximal ribs extending in the stacking direction at the proximal shelf 22 for engaging a proximal side of a front portion of the stack 10 to ensure that the stack is suitably urged toward the roller 15.

It is not just the degree of grip between the roller 15 and the sheet product, but also the height of the proximal shelf 22 and the angle of inclination of the housing 40 relative to the vertical that serves to control pressure between the front-most sheet in the stack 10 and the roller 15 in this embodiment. The height of the proximal shelf 22 in the stacking direction may be adjusted, for example by a user operable adjuster, in order to relieve or increase this pressure so that the configuration of the support structure 12 is optimized to ensure that the correct number of sheet products is dispensed according to a user's choice at the actuator 2.

The extent to which the housing 40 is filled by the stack of sheet products may influence the resulting pressure on the roller 15. In one embodiment, a fill line 6 (FIG. 1) indicates to a user a stack level that should be maintained for desired function of the dispenser. Alternatively, a weight could be applied in addition to the stack weight to ensure suitable pressure on the roller 15. In yet another alternative embodiment, a biasing element, such as a spring, could push the stack onto the roller 15.

Figure 6A:
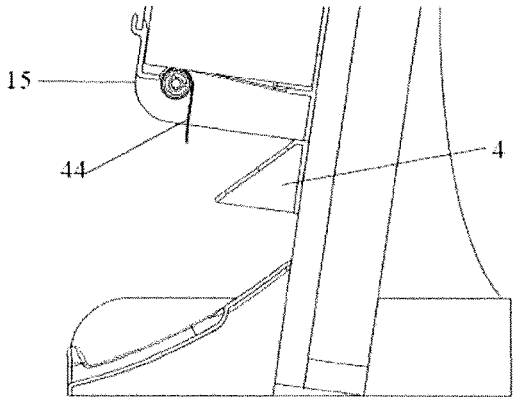
FIGS. 6A, 6B, and 6C show perspective views of how sheet products are presented to a user during dispensing by the dispenser of FIG. 1.
Figure 6B:
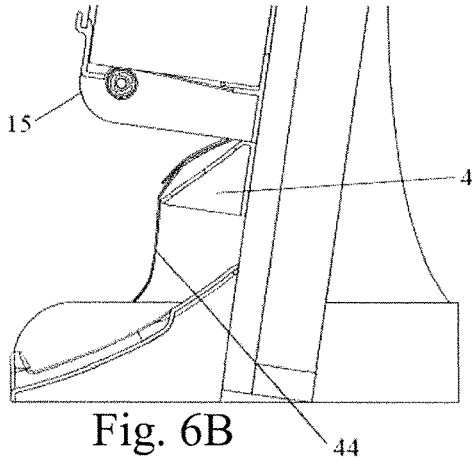
Figure 6C:
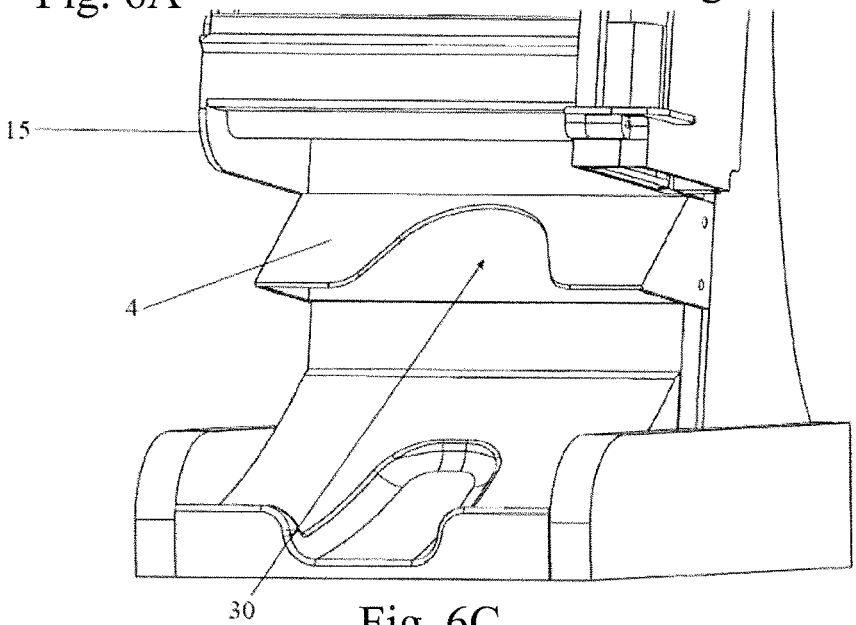
Figure 7A:
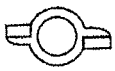
Figure 7B:
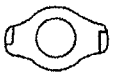
Figure 7C:
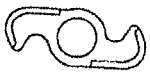
Figure 7D:
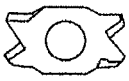
Figure 7E:
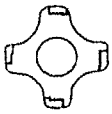
Figure 7F:
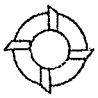
Figure 7G:
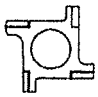
Figure 7H:
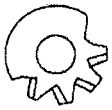
Figure 7I:
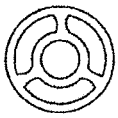

Referring to FIGS. 1 and 6*c*, a support chute 4 is provided that is positioned beneath the dispensing opening 41. The support chute 4 is located beneath the distal shelf 21 so that sheet products hanging in the dispensing opening 41, suspended at the distal margin, lie on the support chute 4. The support chute functions to relieve some of the weight of the sheet product tending to pull that sheet product away from the distal shelf 21, which would result in undesirable complete or uncontrolled release of the sheet products from the support structure 12. The support chute 4 includes a peripheral cut-out 30 positioned so that the hanging sheet product or products lie over the cut-out 30, thereby allowing a user to grasp the hanging sheet product(s) from both sides, one side through the cut-out 30. A recess instead of a cut-out could provide a similar function. The support chute 4 is angled so as to curve the folds or edges of the hanging sheet products toward a user for ease of grasping and quality of presentation purposes. The support chute 4 thus provides an angled slide intercepting direct vertical hanging of the sheet products.

Referring to FIGS. 1 to 5 in conjunction with FIGS. 6*a*, 6*b*, and 6*c*, an exemplary operation of the dispenser will now be described. In particular, the roller operates relatively closely to a proximal side of the front face of the stack so as to release the proximal side of one or more sheet products from the proximal shelf. The distal side of the released sheet products are securely held, pinched between the distal shelf of the support structure and the remainder of the stack, to thereby provide a suspension location from which the one or more sheet products hang. The dispenser comprises a support chute that comes into contact and supports the one or more hanging sheet products to relieve tension required to suspend the distal side of the hanging sheet products. The support chute includes a peripheral cut-out or recess for allowing a user to grasp the hanging sheet products on opposing faces.

In order to dispense a desired number of sheet products, such as napkins, a user presses on the user interface ledge 27 or on the user interface ledge 28 with fingers, depending on whether a smaller or larger number of sheet products is required. For example, if the dispenser 1 is located at a drive-through window, the user interface ledge 27 could be associated with a small food order and the user interface ledge 28 could be associated with a large food order. Of course, further user interfaces could be provided to provide a greater range of numbers of sheet products that can be dispensed. The moveable actuator part 19 moves linearly under direction of the user pressing on one of the user interface ledges 27, 28. Linear motion of the moveable actuator part 19 is converted to rotational motion of the roller 15 by way of the rack and pinion device.

The stack 10 is disposed in the housing 40 and rests against the distal and proximal shelves 21, 22. A front face of the stack 10 curves partially around the roller 15 as a result of the relative positioning of the distal and proximal shelves 21, 22. The roller 15 is pressed into the front face of the stack of sheet products to engage a front-most sheet product, rather than edges or folds which would be the case with engagement of the side faces of the stack. Rotation of the roller 15 causes the front-most sheet product of the stack 10 in engagement therewith to retract relative to the proximal shelf 22 in a manner that involves sliding against an underlying sheet in the stack. The grip between the outer surface of roller 15 and the front-most sheet product is greater than a corresponding frictional force between the front sheet product and the underlying sheet product in the stack 10 so that it is able to be slid or moved relative thereto. Once the front-most sheet product is moved off the proximal shelf 22, continued rotation of the roller 15 results in an edge of the gripped sheet product moving beyond the roller 15 and into the dispensing opening 41.

Once the sheet product has been released by the roller 15, the sheet product will, in the illustrated gravity feed embodiment, fall from the proximal edge or fold into a hanging position extending through the dispensing opening 41. A distal margin of the sheet product is not acted on by the roller 15 and thus remains pinched between the proximal shelf 21 and the remainder of the stack 10 to provide a suspension point allowing the sheet product to hang.

Depending upon which of the user interface ledges 27, 28 is pressed, the above-described dispensing process will be repeated by rotation of the dispensing roller 15 by a different amount so that one or a plurality of sheet products is/are hanging through the dispensing opening 41, suspended at the distal shelf 21. The hanging sheet products will lay to some extent on the underlying support chute 4, ready to be grasped by a user. A user may then reach in and grasp from both sides of the hanging sheet products, by making use of the cut-out 30 in the support chute 4, and pull them to release the hanging sheet products from the pinch at the distal shelf 21. The sheet products can then be bagged or immediately used for wiping.

Referring to FIG. 6B, it can be seen that the hanging sheet products define a tail 44 that extends beyond the support chute 4. This may result from the use of the roller 15 in an interfolded sheet product arrangement. Referring to FIG. 6A, an initial position of the tail 44 can be seen before the roller 15 has been operated to release the sheet product associated with the tail 44. This tail 44 is not pinched at a distal margin between the remainder of the stack and the distal shelf 21, so that when the roller 15 is rotated, the tail 44 hangs beyond the folded sheet products that are still suspended at the distal shelf 21. Imagining a user grasping on the hanging sheet products shown in FIG. 6B, this would pull out a new tail of the front-most sheet product in the stack, thereby producing a succeeding sheet product arrangement as shown in FIG. 6A. This tail 44 is folded behind the hanging sheet products by a user when grasping them, thereby making further use of the peripheral cut-out 30 of the support chute 44.

A number of alternatives or additions could be provided by the skilled person to the above embodiment.

In the above embodiments, the cross-section of the roller 15 is generally circular, as shown in, for example, FIGS. 4 and 71. FIGS. 7A to 7H show yet further alternatives in which the cross-section is different from that of exemplary roller 15. In these alternative embodiments, the profile of the roller includes fins, paddles or lobes. Between the fins, paddles or lobes are relatively recessed parts of the profile that will slip, e.g., slide or not contact, with respect to the front face of the stack 10. The slip parts of the alternative roller designs allow a front-most sheet to be dispensed without disturbing a succeeding sheet, whereby the slip part of the roller is positioned in registration with the succeeding sheet. It is only when the roller is further rotated such that the next fin, paddle or lobe engages and grips the succeeding sheet that a succeeding sheet begins to be dispensed.

An indexing system may be applied in association with non-circular alternatives of the roller, to promote an intended starting position for a particular fin, paddle or lobe thereby ensuring that the dispensing process selected by the user at the actuator 2 is properly implemented. The non-symmetrical configuration of the roller designs of FIGS. 7A to 7H include a particular starting position for the roller in the dispensing process of engaging, gripping and moving a front-most sheet of the stack 10 into the dispensing opening 41 as a result of a set amount of movement in the actuator 2. An exemplary indexing system 45 is shown in FIG. 8.

Figure 8:
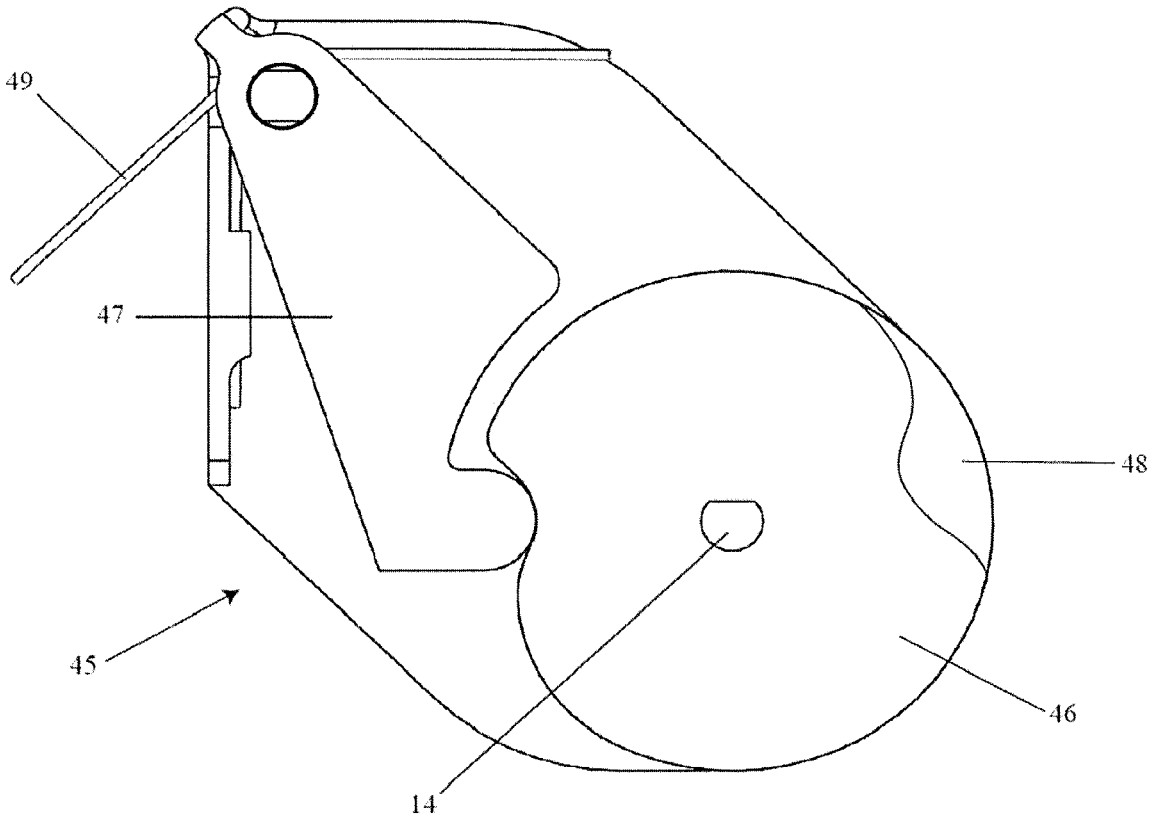
FIG. 8 shows a perspective view of an indexing device for use with a lobed, paddled, finned or the like roller of the dispensing member.

In FIG. 8, a cam wheel 46 is mounted to, and rotates with, the central shaft 14 of the roller. The cam wheel 46 may be mounted on the other side of the support structure 12 to the actuator 2. A cam follower 47 is urged by a torsion spring 49 onto an outer profile of the cam wheel 46. The outer profile of the cam wheel 46 includes recessed portions 48 that are registered with starting or finishing points, as defined by at least one fin, paddle or lobe of the roller. In this way, if the dispensing cycle does not finish so as to eject a sheet product into the dispensing opening 41, the biasing force to which the cam follower 47 is subjected will tend to force or at least bias registration of the cam follower 47 and the recessed portion 48 of the cam wheel 46. For example, if a user does not complete an actuation stroke, the indexing system 45 is able to complete this actuation stroke to ensure that the required number of sheet products is dispensed and to also ensure that the desired starting point for the roller in the dispensing cycle is provided for the next use.

Figure 9:
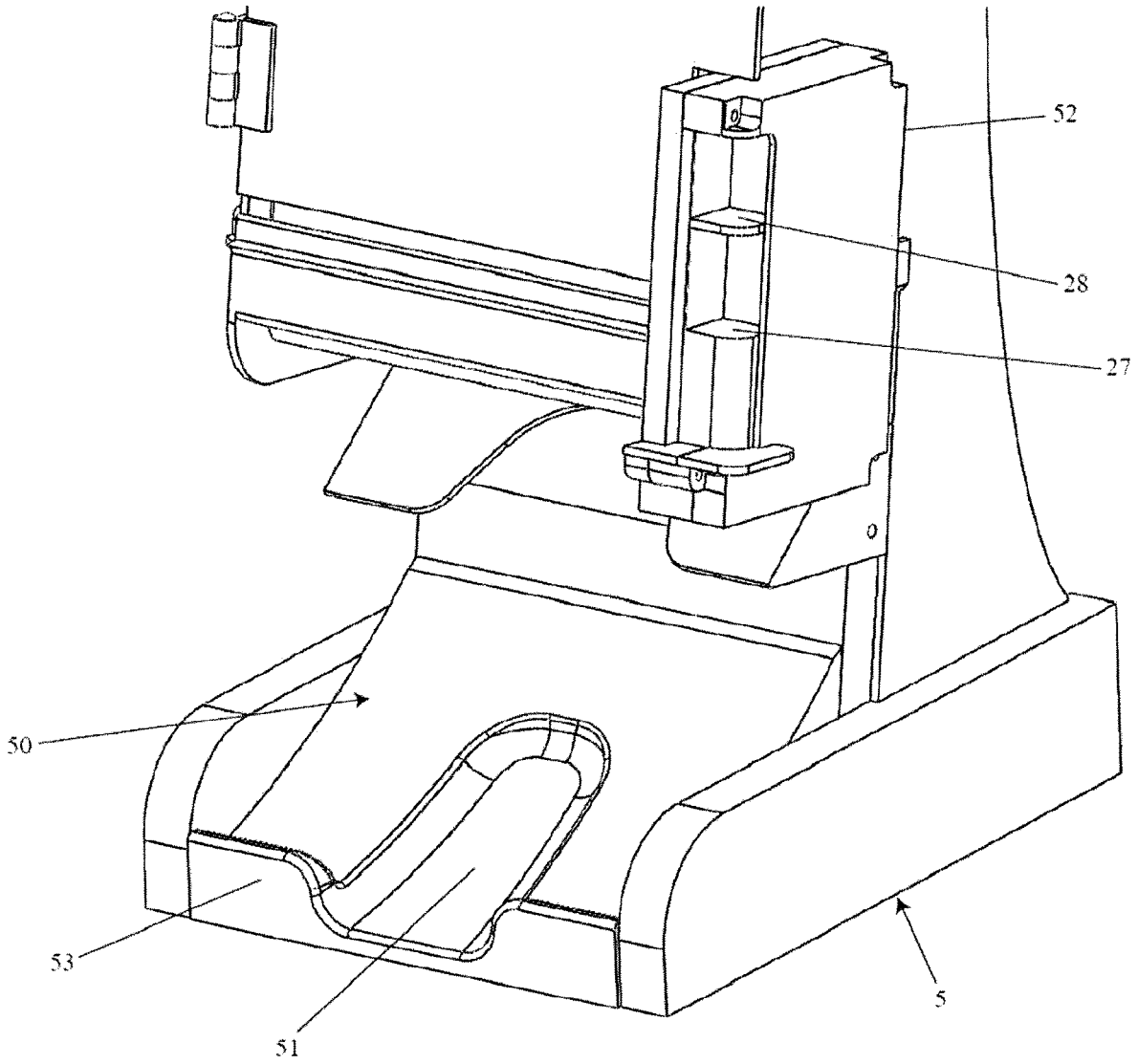
FIG. 9 shows a perspective view of an embodiment of the dispenser with a modified stand including a catch chute for catching any sheet products that fall from the support chute.

Referring to FIG. 9, an alternative embodiment is shown. In this embodiment, the catch chute includes retaining tabs at the end of the catch chute surface. The catch chute also includes a recess so that sheet products supported on the catch chute surface are graspable by a user on opposing faces.

In one modification, a catch chute 50 is provided that is located between feet of the stand 5 and positioned so as to catch any sheet products that fall from the dispensing opening 41 and the support chute 4. The catch chute 50 provides a sloped surface as a downward slide for any sheet products that have fallen, and also includes tabs 53 to stop movement of the fallen sheet products so as to hold them supported on the slide surface. The catch chute 50 further includes a recessed portion 51 that is generally centrally located and recessed relative to the slide surface of the catch chute 50 and which provides an opening at the tabs 53 to allow a user to grasp the sheet products from both faces.

FIG. 9 provides a further modification, which was mentioned as a possibility in the description above, of a further user interface ledge 52, so that a third, yet larger number of sheet products may be dispensed. This embodiment has first, second and third user interface ledges 27, 28 and 52 for allowing a user to select between small, medium and large numbers of sheet products, which may correspond to small, medium and large food orders at, for example, a fast-food drive-through window. Each of the user interface ledges 27, 28 and 52 defines different stroke lengths for the moveable actuator part 19, which correspond to different respective amounts of rotation of the roller 15. As an example, the first user interface ledge 27 could cause the roller 15 to rotate an amount sufficient to dispense one fold of interfolded sheet products, thereby providing two individual sheet products. Likewise, the second user interface ledge 28 could be associated with dispensing four individual sheet products and the third user interface ledge 52 could be associated with dispensing six individual sheet products.

Figure 10:
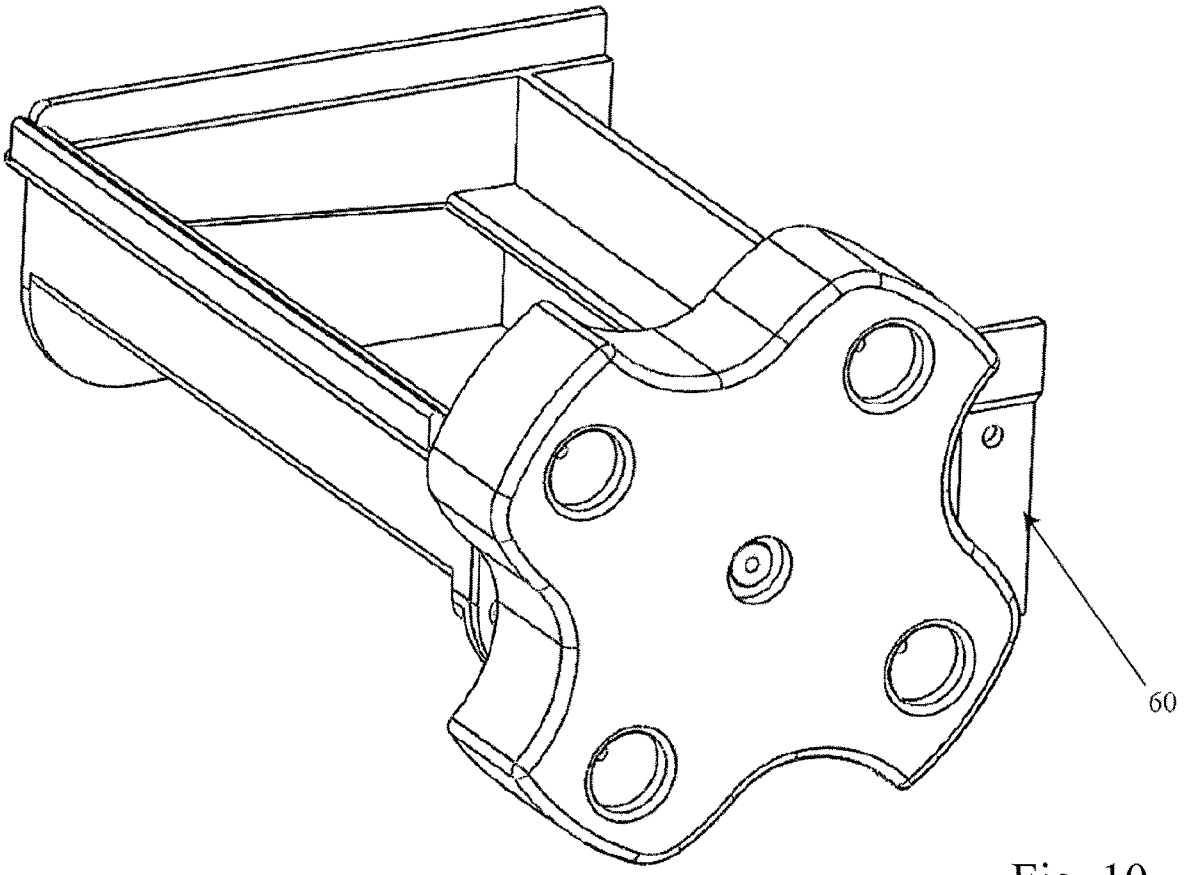
FIG. 10 shows a perspective view of an alternative embodiment of the actuator in which a rotatable handle is used to transmit rotational motion to a roller that is not shown.

Referring to FIG. 10, an embodiment of the first and third aspects is shown, in which the actuator is in the form of a geared rotation knob that meshes with a gear fixed to the central shaft 14 of the roller 15. In this alternative embodiment, the actuator transmits rotational movement imparted by a user to cause rotational movement of the roller 15.

Figure 11:
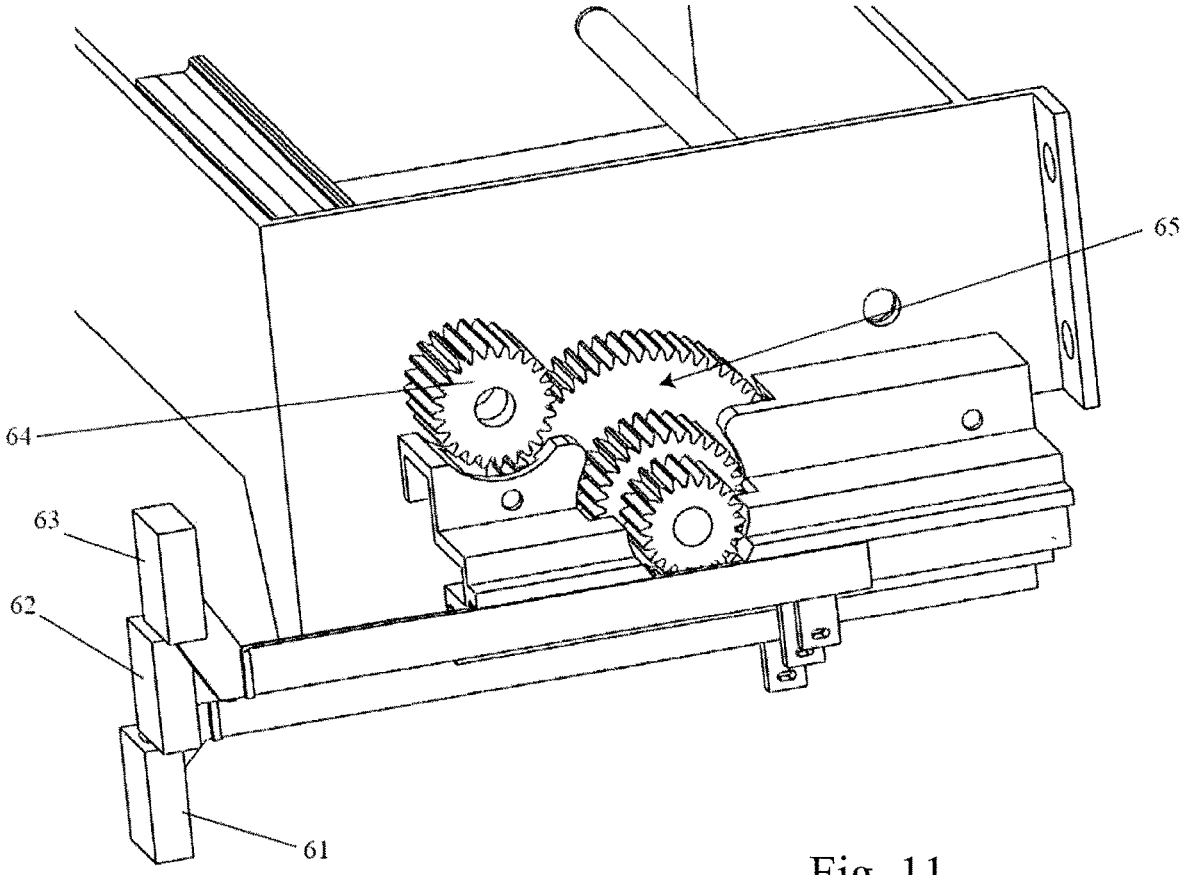
FIG. 11 shows a perspective view of an alternative actuator including separate push buttons associated with different rack and pinion devices for selectively applying different amounts of rotation to the roller for respectively dispensing different numbers of sheet products.

FIG. 11 shows another alternative embodiment for which there are provided three separate push buttons 61, 62, 63 that are moveable through the same actuation stroke, but respectively impart differing amounts of rotation on the roller 15 so as to cause different numbers of sheet products to be dispensed. In that specific embodiment, each of the push buttons 61, 62, 63 is respectively associated with a rack gear that engages a compound gear 65. The compound gear 65 meshes with a gear 64 associated with the roller 15. The compound gear 65 has gear components of different sizes respectively meshing with one of the rack gears associated with the push buttons 61, 62, 63. The compound gear 65 thus transmits different amounts of rotation to the gear 64 so as to impart a different amounts of rotation to the roller 15 depending upon which of the push buttons 61, 62, 63 is pressed. Further, in the embodiment of FIG. 11, the push buttons 61, 62, 63 are moved perpendicularly to the stacking direction, rather than parallel to the stacking direction as with the embodiments of FIGS. 1 to 9, to cause rotation of the roller 15.

Figure 12:
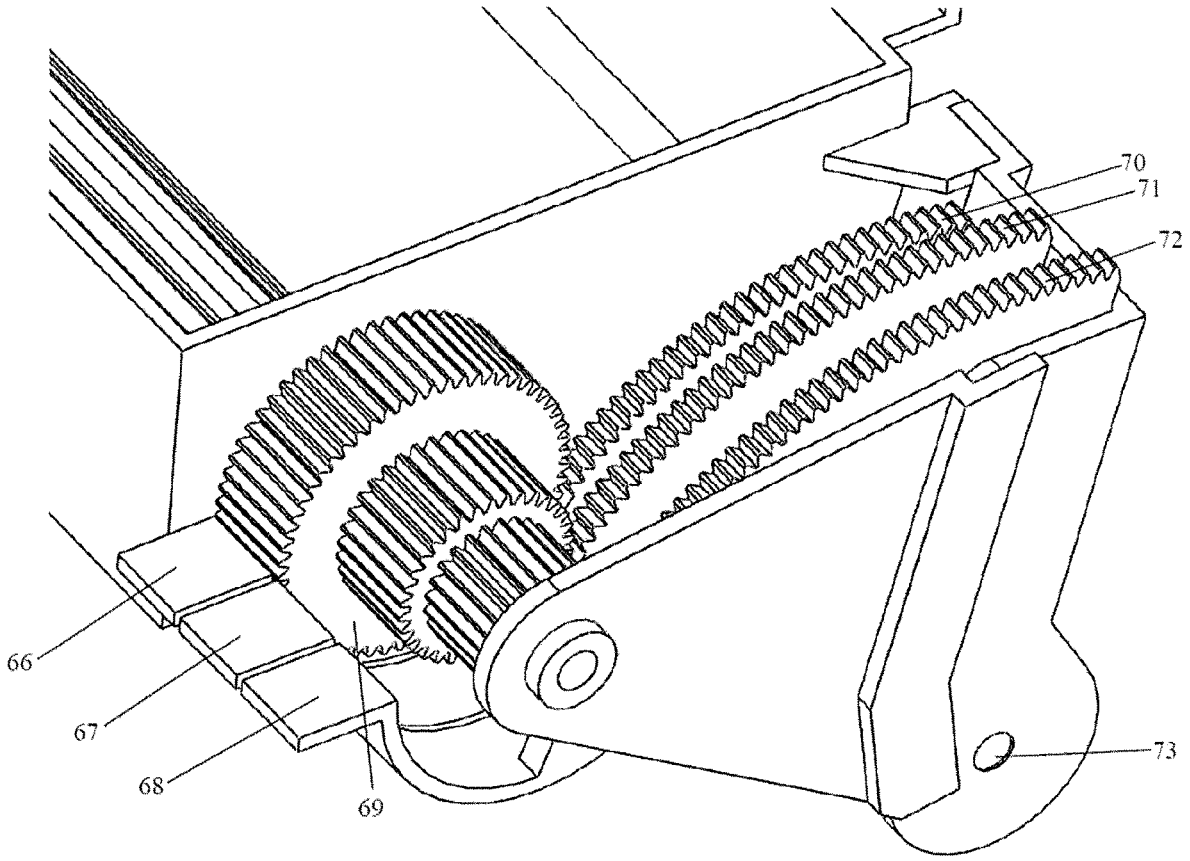
FIG. 12 shows a perspective view of a first alternative embodiment of the actuator in which, instead of linear motion of the actuator being converted to rotational motion of the roller, the push buttons follow a rotational path that is transmitted to rotational motion of the roller.

A yet further alternative embodiment of the actuator is shown in FIG. 12. In FIG. 12, the actuator includes three different push buttons 66, 67, 68 that impart different amounts of rotation to the roller 15 using the same stroke length. In particular, a compound gear 69 is provided that has different gear size portions that mesh with sector gears 70, 71, 72, respectively associated with the first to third push buttons 66, 67, 68. Like in the previous alternative embodiment of FIG. 11, the stroke length associated with each of the push buttons 66, 67, 68 is the same, while respectively dispensing different numbers of sheet products, which is enabled by way of the compound gear 69 having differing gear size portions. In the alternative embodiment of FIG. 12, each of the push buttons 66, 67, 68 moves along an arc, rotating about a pivot 73, in order to effect the dispensing process. Thus, the various embodiments support linear motion along different axes, arc-like motion, and rotational motion for the user actuation interface.

Figure 13:
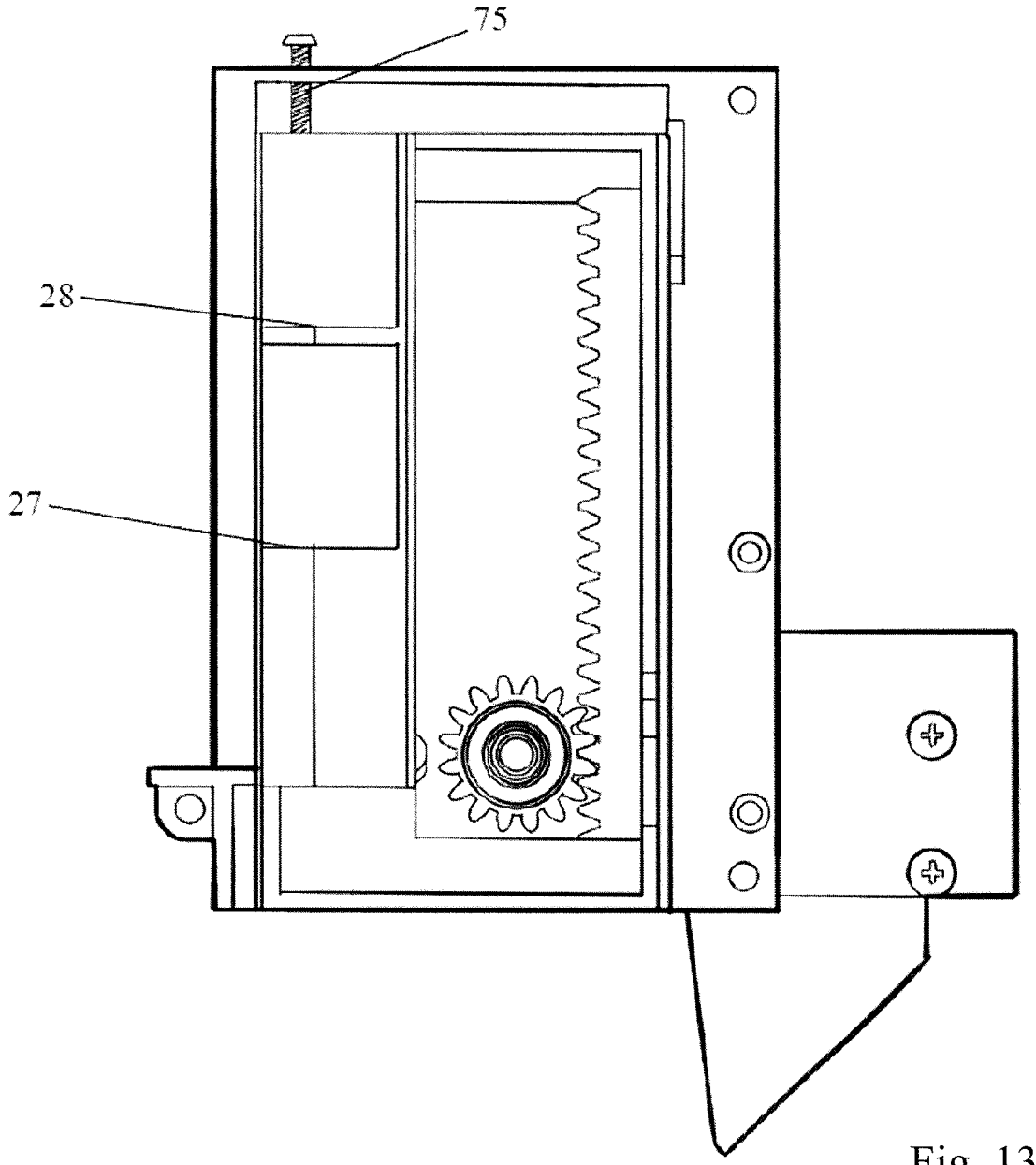
FIG. 13 shows a side view of an embodiment of an adjustable stop feature that permits adjustment of the location of one end of the actuation stroke. That feature permits adjustment of the abutment or stop position of the moveable actuator part relative to the stationary actuator part for defining different stroke lengths. This adjustment feature allows a user to adjust the stroke length, which may be useful to compensate for different slip properties associated with the different types of sheet product used with the dispenser.

FIG. 13 shows one exemplary modification in which the actuator includes an adjustable stop 75 allowing the start and finish point of the actuation stroke to be adjusted in order to calibrate the length of the actuation stroke to ensure the desired number of sheet products is dispensed. That feature permits adjustment of the abutment or stop position of the moveable actuator part relative to the stationary actuator part for defining different stroke lengths. This adjustment feature allows a user to adjust the stroke length, which may be useful to compensate for different slip properties associated with the different types of sheet product used with the dispenser.

In particular, different sheet properties (such as calliper, embossing depth and/or material) of the sheet products may cause a slight variation in the relationship between amount of rotation of the roller and the number of sheet products dispensed. Accordingly, the actuator or the dispensing device may include an adjuster in order to compensate for changes in that relationship for different types of sheet product. In the embodiment of FIG. 13, the stop 75 can be adjusted to shorten or increase the stroke length, thereby changing the amount of rotation of the dispensing roller for each of the user interface ledges 27, 28.

In another alternative embodiment, the actuator could be electronic. In particular, an electric motor could be provided to turn the dispensing roller. Further, one or more actuation buttons could be utilized to dispense the desired number of sheet products. In one particular form of the electronic implementation of the actuator, respective control buttons could be provided that cause the electric motor to rotate the dispensing roller by a different amount in order to respectively dispense different numbers of sheet products.

Referring to FIG. 4, the shelves 21, 22 are provided as planar ledges, although alternative forms of the shelves are also contemplated. For example, a rod or rods could be used in place of the proximal shelf 22 and/or the distal shelf 21. Such a rod or rods would still be shelf-like and support a margin of the front face of the stack, allowing them to be described as shelves.

In another alternative embodiment, and with reference to FIG. 2, the roller 15 could be oriented in alignment with a short side of the stack, rather than with a long side of the stack. In such an embodiment, the shelves 21, 22 could also be arranged at opposed short sides of the stack for contacting margins of the short sides of the front of the stack, rather than the long sides as shown.

Embodiments described herein also contemplate an alternative dispensing process that obviates the user operating the actuator. Turning to FIG. 6(*a*), the user could simply grab the tail 44 to dispense the front-most sheet product. In one alternative, the user grasping the tail 44 could dispenser a first number of sheet products (e.g., two) and the actuator may be configured to cause the dispensing member to dispense second and third greater numbers of sheet products (e.g., four and six, respectively).

In another alternative embodiment, a dispenser includes more than one dispensing roller. Referring to FIG. 4, the dispenser may include a plurality of dispensing rollers that engage the front face of the stack and which are moveable to dispense one or more sheet products. For example, the dispensing rollers could move in conjunction or separately. In one form, operation of the actuator could cause the dispensing rollers to move in conjunction to dispense one or more sheet products. In an alternative version, the actuator may operate on different dispensing rollers depending upon which user interface is activated. The different dispensing rollers may be configured, e.g., sized, to dispense different respective numbers of sheet products.

The invention claimed is:

1. A dispenser comprising:

a housing configured to hold a stack of sheet products in an interior volume thereof;

a support structure at one end of the housing against which a front face of the stack is to be supported, wherein the support structure comprises:

one or more shelves to support the front face of the stack; and a dispensing opening in the support structure adjacent the one or more shelves that reveals at least a portion of the front face of the stack when a front-most sheet product forming the front face of the stack is in contact with the one or more shelves, wherein the support structure is configured to hold the stack in position against a weight of the stack or for holding the stack in position against a force of a biasing member acting on the stack so that the front face of the stack is pressed against the support structure by virtue of the weight of the stack or the urging provided by the biasing member such that a front-most sheet product is pinched between the other sheet products in the stack and one or more shelves of the support structure; and a dispensing member positioned to engage and to press, in the stacking direction, into the portion of the front face of the stack revealed within the dispensing opening at a location in the dispenser the same distance or closer to the end of the housing opposite to the support structure than at least one of the one or more shelves, wherein the dispensing member is moveable and adapted to grip the portion of the front face of the stack revealed within the dispensing opening and to grip and move the front-most sheet product off at least a portion of the support structure to separate a portion of the front-most sheet product from a remainder of the stack for dispensing from the dispensing opening while another portion of the front-most sheet product is being pressed against underlying sheet products in the stack, wherein the dispensing member and support structure are arranged so that the dispensing member moves one portion of the front-most sheet product to hang through the dispensing opening with the front-most sheet product no longer contacting the dispensing member and for grasping by a user, while another portion of the front-most sheet product remains pinched between the other sheet products in the stack and one of the one or more shelves of the support structure that is on an opposed side of the dispensing opening from the dispensing member.

2. The dispenser according to claim 1, wherein the dispensing member is configured to move a fold or edge of the front-most sheet product by gripping and moving a face of the front-most sheet product.

3. The dispenser according to claim 1, wherein the dispensing member is configured to move the front-most sheet product past a barrier so that once the barrier is cleared, the front-most sheet product passes into the dispensing opening.

4. The dispenser according to claim 1, wherein the dispensing member is positioned adjacent one of the one or more shelves and is configured to move the front-most sheet product from off the shelf adjacent the dispensing member as the front-most sheet product is moved into the dispensing opening.

5. The dispenser according to claim 1, wherein the dispensing member is positioned closer to one edge of the front face of the stack than to an opposed edge.

6. The dispenser according to claim 1, wherein the dispensing member is configured to move one edge or fold of the front-most sheet product into the dispensing opening for grasping by a user, while an opposed edge or fold of the sheet product remains stationary.

7. The dispenser according to claim 1, further comprises an actuator that is user operable to cause the dispensing member to move relative to the sheet products in the stack to dispense one or more sheet products.

8. The dispenser according to claim 1, wherein the dispensing member is moveable to move a sheet product adjacent the dispensing opening into the dispensing opening, and, as a result of a preceding sheet product being cleared by moving it into the dispensing opening, the dispensing member is positioned for engaging and gripping a succeeding sheet in the stack and configured to move the succeeding sheet into the dispensing opening for grasping by a user.

9. A method comprising loading a stack of sheet products into the housing of the dispenser according to claim 1.

10. The dispenser according to claim 1, wherein the dispensing member is turnable to move the front-most sheet product into the dispensing opening.

11. The dispenser according to claim 10, wherein an axis about which the dispensing member turns is disposed parallel to sheet faces in the stack.

12. The dispenser according to claim 1, wherein the dispensing member is provided as a roller engaging the front face of the stack adjacent the dispensing opening.

13. The dispenser according to claim 12, wherein a peripheral surface of the roller grips a face of the front-most sheet product at the front face of the stack adjacent the dispensing opening.

14. The dispenser according to claim 13, wherein the roller defines a cylindrical outer profile for engaging the front-most sheet product.

15. The dispenser according to claim 14, wherein the cylindrical outer profile includes lobes, paddles, or fins that engage the sheet product.

* * * * *